US007174606B2

(12) United States Patent
Möller et al.

(10) Patent No.: US 7,174,606 B2
(45) Date of Patent: Feb. 13, 2007

(54) PRESSURE CYLINDER FOR A DRAFTING ARRANGEMENT OF A TEXTILE MACHINE

(75) Inventors: Rudolf Möller, Gehrden (DE); Dirk Kröger, Laatzen (DE); Salih Agca, Hannover (DE); Christoph Leinders, Korschenbroich (DE)

(73) Assignee: Rexroth Mecman GmbH, Hannover (DE)

( * ) Notice: Subject to any disclaimer, the term of this patent is extended or adjusted under 35 U.S.C. 154(b) by 342 days.

(21) Appl. No.: 10/721,741

(22) Filed: Nov. 26, 2003

(65) Prior Publication Data

US 2004/0139851 A1 Jul. 22, 2004

(30) Foreign Application Priority Data

Nov. 28, 2002 (DE) ..... 102 55 640

(51) Int. Cl.
*D01H 5/00* (2006.01)

(52) U.S. Cl. ..... 19/236

(58) Field of Classification Search ..... 19/236, 19/239, 240, 245, 248, 250, 258, 260–263, 19/265–272, 274, 295; 92/5 R
See application file for complete search history.

(56) References Cited

U.S. PATENT DOCUMENTS 3,310,847 A * 3/1967 Aurich ..... 19/258
3,409,946 A * 11/1968 Whitehurst ..... 19/292
4,512,061 A * 4/1985 Hartmannsgruber et al. .. 19/239
4,715,264 A * 12/1987 Stoll ..... 91/16
4,890,359 A 1/1990 Kägi et al.
5,953,793 A * 9/1999 Roder ..... 19/266
6,134,752 A * 10/2000 Gohler et al. ..... 19/272
6,154,931 A * 12/2000 Corrales ..... 19/267

FOREIGN PATENT DOCUMENTS

CN 1160824 A 10/1997
EP 0 324 172 A 7/1989
EP 0 939 151 A2 12/1998
EP 0 939 151 A 9/1999

OTHER PUBLICATIONS

European Search Report dated Feb. 3, 2005, issued in.
Chinese Office Action dated Jan. 6, 2006.

* cited by examiner

*Primary Examiner*—Gary L. Welch
(74) *Attorney, Agent, or Firm*—Venable LLP; Robert Kinberg; Ryan M. Flandro

(57) ABSTRACT

A pressure cylinder including a cylinder housing having one end including an opening. A piston is axially displaceable within the cylinder housing. A piston rod is coupled to the piston and extends through the opening at the one end of the cylinder. A cylinder base closes off the cylinder at an end of the cylinder housing opposite the opening. The cylinder also includes a pressure chamber between the piston and the cylinder base and capable of being pressurized by a pressure medium and a switching disk for interacting with a switch to determine the position of the piston. The switching disk is displaceably positioned in the pressure chamber in frictional engagement and coaxially with the piston rod so that the switching disk passes to a starting position near the piston in response to a pressure impulse overcoming the frictional engagement when the pressure chamber is first pressurized.

12 Claims, 1 Drawing Sheet

PRESSURE CYLINDER FOR A DRAFTING ARRANGEMENT OF A TEXTILE MACHINE

CROSS-REFERENCE TO RELATED APPLICATION

This application claims the priority of German Patent Application No. 102 55 640.7-14 filed Nov. 28, 2002, the disclosure of which is incorporated herein by reference.

BACKGROUND OF THE INVENTION

The present invention relates to a pressure cylinder comprising a piston axially displaceable within a cylinder housing and able to be pressurized by a pressure medium, a piston rod extending through at least one cylinder cap closing off said cylinder housing at one end, wherein a switching disk is provided to be displaceable on, and in coaxial frictional engagement with, the piston rod interacting with a switch to determine the position of the piston on the inside.

Such a pressure cylinder is preferably used in the textile machine industry. In a drafting arrangement for fiber material, the pressure cylinder is used as a loading device. A drafting arrangement essentially comprises an arrangement of top and bottom rollers, and a plurality of pressure cylinders applying a load to the top rollers via pressure rods. Accordingly, the support of the top roller is usually of the floating type. Fiber material is continuously passed between the rollers and drafted, i.e. extended, by a series arrangement of a plurality of such drafting arrangements. To do this, the individual drafting roller arrangements are operated at different speeds.

European Patent Application EP 0 939 151 A2 discloses such a drafting arrangement where the loading device is equipped with pressure cylinders. The loading device essentially comprises a loading arm for the top rollers of the drafting arrangement. The three top rollers are adjacent to associated bottom rollers. The top rollers are rotatably supported at both ends in corresponding bearings and are pressed against the bottom roller by the loading device in order to create a permanent frictional engagement with the passing fiber material, so the latter can be extended when it passes through the drafting frame. The spaces between the top rollers are made to be adjustable because different spaces are required depending on the fiber material to be stretched. The pressure force on the top rollers generated by the loading device is controlled by a pressure of a pressure medium in the form of pressurized air applied to the loading device via suitable pressure lines. The loading arm is also pivotable about a pivot point, so that the loading arm may be opened to make the drafting arrangement accessible when new fiber material is to be inserted or malfunctions are to be removed.

The loading devices used for this purpose are essentially pressure cylinders in which one piston is arranged to be unilaterally pressure-loaded. Pressurized air is supplied to the side of the piston facing away from the piston rod so that the pressure force generated is transferable to the top roller via the piston rod. A switching-off device is integrated into the loading device. The switching-off device serves to control the textile machine and provides electrical signals to the textile machine's control unit. It serves to detect the position of the piston rod in order to determine the load on the top rollers of the drafting frame so that the drafting frame may, for example, be switched off in case of malfunction.

In the operation of such drafting frames it may occur that so-called muffs are formed on the top rollers, i.e. that fiber material gets wound on the top roller. This leads to a critical operational state, since it may result in the bearings of the top and bottom rollers being excessively loaded, and the covers of the top rollers which create frictional engagement may be damaged. Muffs of this type adhere extremely well to the top rollers and are usually only detached with great difficulty. The switching-off device thus generates a signal evaluated by the control unit and shutting down the drafting frame if necessary. The switching-off device essentially comprises a switch that can assume two switching positions. In one of the switching positions the switch contacts a contact disk while in the other of the two switching positions, the switch is adjacent to the pressure cylinder or between the switching disk and the pressure cylinder. The switch in the present example is formed as an electrically conductive disk in a sliding fit on the piston rod, resulting in a frictional engagement with the piston rod. When the piston rod moves, the switching disk is displaced accordingly along the piston rod. The switching-off device is positioned in the cylinder cap.

Now, if a muff is formed, the floating top roller is pressed towards the pressure cylinder. The pressure rod of the pressure cylinder contacting the top roller is thus moved toward the retracted end position. When retracting the pressure rod, the switching disk mounted in frictional engagement passes through the switch, thus switching off the drafting frame. The drafting frame may now be manually opened and the muff removed. Afterwards, the drafting frame can be brought back into its operating position by closing the loading arm.

In practice it has been found that a readjustment of the pressure rod of the pressure cylinder may occur when such work is carried out. If the pressure rod is pushed back, this is an uncritical condition since on pressurizing the pressure cylinder again, the switching disk is carried along into its bottom end position by the piston rod. If, however, the pressure rod is extended, the pressure rod will be pushed back again when the loading arm is closed. Due to the frictional engagement on the pressure rod, however, the switching disk will be pushed into its top end position. This end position will then erroneously be recognized as a muff by the switching-off device, which is interpreted by the control unit accordingly, preventing the drafting frame from resuming its operation. The problem with the above prior art is therefore that the prior switching-off device may report undefined operational states.

SUMMARY OF THE INVENTION

It is therefore an object of the present invention to provide a pressure cylinder, in particular for a drafting frame of a textile machine, wherein it is realized with simple technical means that an associated switch issues unequivocal signals to determine the current operational state.

The above and other objects of the invention are achieved by a pressure cylinder including a cylinder housing having one end including an opening, a piston axially displaceable within the cylinder housing, a piston rod coupled to the piston and extending at least through the opening at the one end of the cylinder, a cylinder base closing off the cylinder at an end of the cylinder housing opposite the opening, a pressure chamber defined between the piston and the cylinder base and capable of being pressurized by a pressure medium, and a switching disk for interacting with a switch to determine the position of the piston, the switching disk being displaceably positioned in the pressure chamber in frictional engagement and coaxially with the piston rod so that the switching disk passes to a starting position near the piston in response to a pressure impulse overcoming the frictional engagement when the pressure chamber is first pressurized.

Further objects of the invention are achieved by drafting arrangement for a textile machine that includes in combination a drafting frame having rollers and a pressure cylinder according to embodiments of the present invention for applying a load to at least one of the rollers of the drafting frame.

Further objects of the invention are achieved by a method of drafting material that includes passing the material between rollers on a drafting frame and utilizing a pressure cylinder according to embodiments of the invention to apply a load to at least one of the rollers and to switch off the drafting frame when a muff forms on the at least one roller.

A particular advantage of the approach according to the present invention is that after operation is resumed a defined starting position is ensured in all circumstances. When the pressure cylinder according to the present invention is used in a drafting frame, the switching disk is always transferred to the bottom starting position near the piston after a muff is removed and when operation is resumed. This resetting is achieved solely by the first pressure impulse on the pressure cylinder upon resumption of operation.

It is also conceivable to achieve the same function by a spring biased piston, since by these mechanical means the piston would always retract to the desired end position even in an unpressurized state. To achieve this, however, the frictional force acting between the switching disk and the piston rod would have to be very strong. It must be ensured that when a muff is generated, the switching disk remains stuck on the piston rod and withstands the spring force. This obvious solution, however, has a disadvantage in that a considerably increased structural size would be necessary for the pressure spring. Moreover, a considerable portion of the force to be generated by a pressure would be lost due to the opposing spring force.

Preferably, the outer diameter of the switching disk should be much smaller than the inner diameter of the cylinder housing, so that the switching disk is provided with a maximally effective surface for the pressure impulse. On the other hand, the outer diameter of the switching disk must be small enough to exclude the danger of any jamming within the cylinder housing.

According to a further improvement of the present invention, the switching disk is mounted on a coaxial extension of the piston rod extending in the direction of the pressure chamber. For this purpose, the switching disk should be equipped with a sleeve-like lug to provide guidance along the piston rod. This sleeve-like lug prevents jamming of the switching disk on the piston rod. The frictional engagement of the switching disk on the piston rod may be realized in a simple way using an elastomeric ring, held in a corresponding groove on the side of the switching disk, preferably in the area of the sleeve-like lug. Using these simple technical means, the required frictional engagement between the switching disk and the piston rod may be achieved.

Furthermore, a shoulder ring may also be provided which protrudes radially toward the inside of the cylinder housing and serves on the one hand as an end stop for the piston and on the other hand as an end stop of the switching disk near the piston. This allows the axial range of adjustment of the piston and also of the switching disk to be set exactly and subdivided into individual portions. At least one sensor for detecting the current position of the switching disk is provided in the area of axial adjustment of the switching disk. Preferably, the sensor is an inductive sensor which forms the switch for detecting the adjustment of the position of the piston. The inductive sensor interacts with the switching disk which is at least partially comprised of a permanent magnet. The inductive sensor can also be mounted on the outside of the cylinder housing of the pressure cylinder or it may be integrated into its tubular profile and thus hidden.

BRIEF DESCRIPTION OF THE DRAWINGS

Further measures improving on the present invention are presented in the following description of a preferred exemplary embodiment of the invention with reference to the single drawing figure.

DETAILED DESCRIPTION OF THE INVENTION

Figure 1:
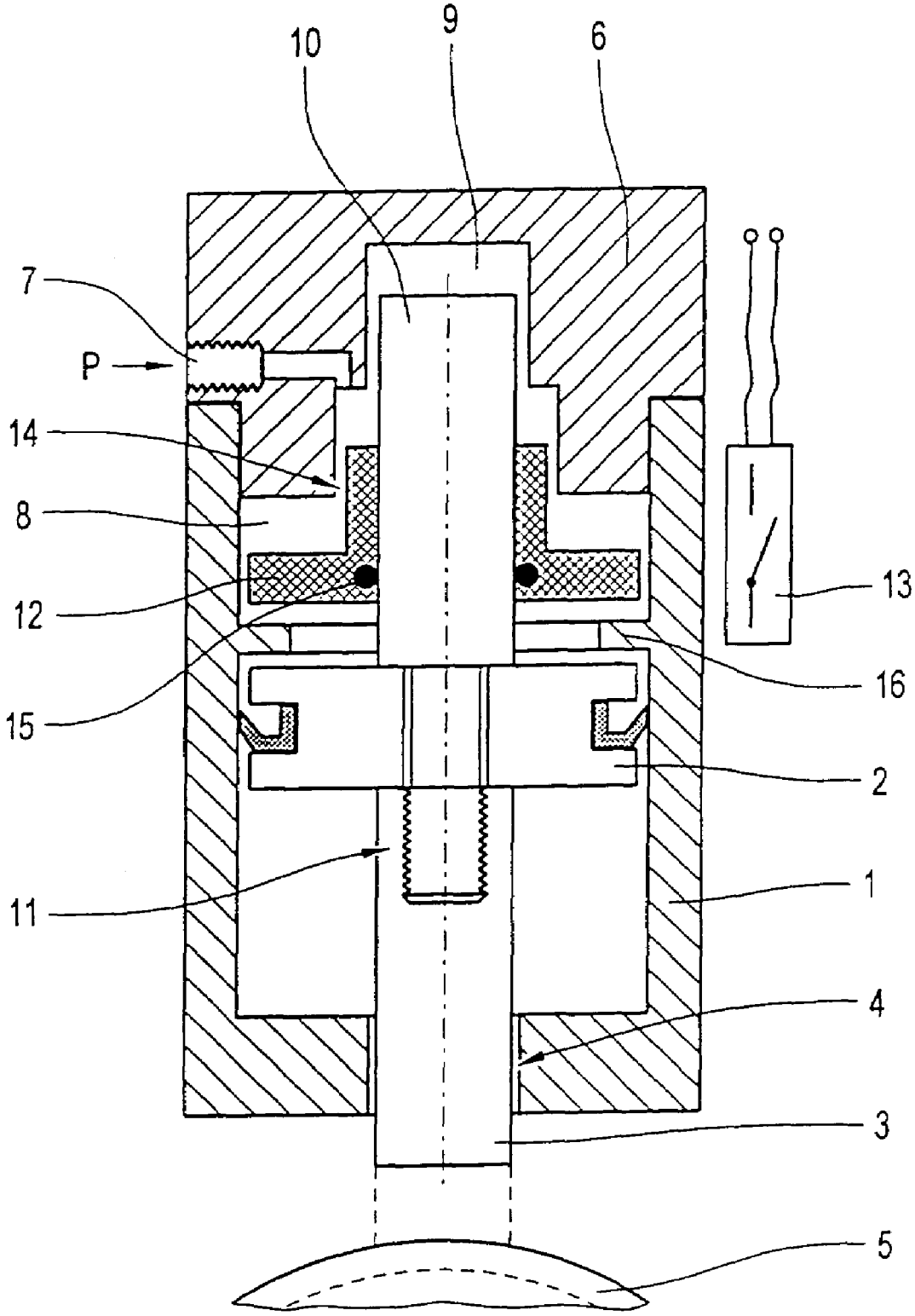
FIG. 1 shows a longitudinal sectional view of a pressure cylinder with an integrated switch for determining the position of the piston in accordance with the invention.

Referring to FIG. 1, there is shown a pressure cylinder which is operated with pressurized air. The pressure cylinder comprises a cylinder housing 1, in which a piston 2 is axially moveable. A piston rod 3 extends from piston 2. Piston rod 3 extends through a bottom opening 4 of the pot-type cylinder housing 1. Both opening 4 and an inner wall of cylinder housing 1 serve to guide piston 2 together with piston rod 3. Piston rod 3, in a way described above, cooperates with a top roller 5 of a drafting frame for fiber material (for further technical details, please refer to the state of the art initially discussed). The pot-like cylinder housing 1 is closed off by a cylinder base 6 at an end facing away from opening 4. The connection between cylinder housing 1 and cylinder base 6 comprise a snap fit in the present exemplary embodiment. Cylinder base 6 includes a pressure medium inlet opening 7 for pressurizing a pressure chamber 8 of the pressure cylinder. A guiding recess 9 is also formed in an area of pressure chamber 8 in cylinder base 6. Guiding recess 9 corresponds to a cylindrical extension 10 coaxially screwed into piston rod 3 and extending the same. The screw connection 11 also serves to attach piston 2 on piston rod 3.

Extension 10 is provided to mount a switching disk 12. Switching disk 12 in the present exemplary embodiment is wholly comprised of a permanently magnetic material and cooperates with a switch 13 adapted to be an inductive sensor for detecting a position of piston 2. Switching disk 12 is positioned in pressure chamber 8 which in turn is positioned on the side of piston 2 facing away from opening 4 for piston rod 3. Switching disk 12 is also equipped with a sleeve-like lug 14 radially at the inside, to provide guidance along extension 10 of piston rod 3. In this area, the frictional engagement between switching disk 12 and extension 10 of piston rod 3 is achieved by an elastomeric ring 15 in switching disk 12. This makes switching disk 12 displaceable with respect to piston rod 3 and creates frictional forces coaxially with piston 2. A shoulder stop 16 protrudes radially to the inside of cylinder housing 1 serving on the one hand as a top end stop for piston 2 and on the other hand as an end stop of switching disk 12 near the piston.

Switching disk 12 is positioned on the side of pressure chamber 8 between piston 2 and cylinder base 6 so that due to a pressure impulse overcoming the frictional engagement between extension 10 of piston rod 3 and switching disk 12, the latter, as shown, is pressed towards a start position near the piston when pressure chamber 8 is first pressurized. This ensures the defined starting position of switching disk 12 in order to avoid malfunctions in control signal processing.

The invention has been described in detail with respect to exemplary embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A pressure cylinder, comprising:

a cylinder housing having one end including an opening;

a piston axially displaceable within the cylinder housing;

a piston rod coupled to the piston and extending at least through the opening at the one end of the cylinder;

a cylinder base closing off the cylinder at an end of the cylinder housing opposite the opening;

a pressure chamber defined between the piston and the cylinder base and capable of being pressurized by a pressure medium; and a switching disk for interacting with a switch to determine the position of the piston, the switching disk being displaceably positioned in the pressure chamber in frictional engagement and coaxially with the piston rod so that the switching disk passes to a starting position near the piston in response to a pressure impulse overcoming the frictional engagement when the pressure chamber is first pressurized.

2. The pressure cylinder according to claim 1, wherein the switching disk has an outer diameter and the cylinder housing has an inner diameter and the outer diameter of the switching disk is smaller than the inner diameter of the cylinder housing by an amount resulting in the switching disk presenting a maximally effective surface for the pressure impulse.

3. The pressure cylinder according to claim 1, wherein the piston rod includes a coaxial extension extending into the pressure chamber and the switching disk is mounted on the coaxial extension.

4. The pressure cylinder according to claim 1, wherein the switching disk includes a sleeve-like lug positioned radially on the inside of the switching disk to provide guidance along the piston rod.

5. The pressure cylinder according to claim 1, further including an elastomeric ring held in a corresponding groove of the switching disk, wherein the frictional engagement of the switching disk on the piston rod is provided by the elastomeric ring.

6. The pressure cylinder according to claim 1, further comprising a shoulder protruding radially to the inside of the cylinder housing and serving as an end stop for the piston and as an end stop for the switching disk near the piston.

7. The pressure cylinder according to claim 1, wherein the switch is an inductive sensor and the switching disk is at least partially formed as a permanent magnet for interacting with the inductive sensor for determining the position of said piston.

8. The pressure cylinder of claim 1, wherein the pressure cylinder is a unilaterally effective pneumatic cylinder having a single pressure chamber and an opening, and wherein the switching disk is located in the single pressure chamber on the side of said piston facing away from the opening for the piston rod to extend out of the cylinder housing.

9. The pressure cylinder according to claim 8, wherein the piston rod extends through the opening of the cylinder housing, and wherein the cylinder housing is closed off at the other end by the cylinder base.

10. The pressure cylinder according to claim 9, wherein the pressure chamber includes a pressure medium inlet opening for pressurizing the pressure chamber and a guiding recess corresponding to an extension of the piston rod.

11. A drafting arrangement for a textile machine, comprising in combination a drafting frame including rollers and a pressure cylinder according to claim 1 for applying a load to at least one of the rollers of the drafting frame.

12. A method of drafting material, comprising:

passing the material between rollers on a drafting frame; and utilizing the pressure cylinder of claim 1 to apply a load to at least one of the rollers and to switch off the drafting frame when a muff forms on the at least one roller.

* * * * *